US010538368B2

(12) United States Patent
Resnikoff et al.

(10) Patent No.: US 10,538,368 B2
(45) Date of Patent: Jan. 21, 2020

(54) LIDS FOR BEVERAGE CONTAINERS

(71) Applicants: Joshua Isaac Nielsen Resnikoff, Somerville, MA (US); Aaron Brooks Panone, Somerville, MA (US)

(72) Inventors: Joshua Isaac Nielsen Resnikoff, Somerville, MA (US); Aaron Brooks Panone, Somerville, MA (US)

(73) Assignee: JRAP, Inc., Somerville, MA (US)

( * ) Notice: Subject to any disclaimer, the term of this patent is extended or adjusted under 35 U.S.C. 154(b) by 593 days.

(21) Appl. No.: 13/715,578

(22) Filed: Dec. 14, 2012

(65) Prior Publication Data

US 2013/0233898 A1 Sep. 12, 2013

Related U.S. Application Data

(60) Provisional application No. 61/630,616, filed on Dec. 15, 2011.

(51) Int. Cl.
*B65D 47/06* (2006.01)
*A47G 19/22* (2006.01)
(Continued)

(52) U.S. Cl.
CPC ..... *B65D 47/06* (2013.01); *A47G 19/2272* (2013.01); *B65D 43/0202* (2013.01); *B65D 51/145* (2013.01); *B65D 2543/0024* (2013.01); *B65D 2543/00046* (2013.01); *B65D 2543/00092* (2013.01); *B65D 2543/00296* (2013.01);
(Continued)

(58) Field of Classification Search
CPC .. B65D 47/06; B65D 43/0202; B65D 51/145; B65D 2543/00546; B65D 2543/00527; B65D 2543/00296; B65D 2543/00092; B65D 2543/00046; B65D 2543/0024; A47G 19/2272
USPC ..... 222/566–568; 220/711; 215/11.1, 387, 215/274, 276
See application file for complete search history.

(56) References Cited

U.S. PATENT DOCUMENTS 1,978,978 A 10/1934 Bailey
2,447,870 A 8/1948 Polcyn
(Continued)

FOREIGN PATENT DOCUMENTS

WO WO 2010/133154 A1 * 11/2010

OTHER PUBLICATIONS

Cuppow To-Go Lids Mason Jars, Daily Grommet, copyright year on webpage shown: 2010, retrieved Jan. 29, 2013 from the internet: <URL: http://www.dailygrommet.com/products/cuppow-to-go-lids-for-mason-jars>.
(Continued)

*Primary Examiner* — Lien M Ngo
(74) *Attorney, Agent, or Firm* — Patterson Thuente Pedersen, P.A.

(57) ABSTRACT

The invention relates to lids for beverage containers and related methods, for example, a lid to fit within the screw on compression assembly found on standard canning jars to adapt the container to improve a user's ability to consume liquids directly from the vessel. Lids according to certain embodiments of the invention can be used with a wide range of containers like jars, so that the containers can be conveniently used to consume a beverage while avoiding spilling and facilitating extended use and recycling of the containers.

7 Claims, 20 Drawing Sheets

(51) Int. Cl.
*B65D 43/02* (2006.01)
*B65D 51/14* (2006.01)

(52) U.S. Cl.
CPC ..... *B65D 2543/00527* (2013.01); *B65D 2543/00546* (2013.01)

(56) References Cited

U.S. PATENT DOCUMENTS 3,332,565 A 7/1967 Elser
3,445,023 A 5/1969 Giessler et al.
3,437,254 A 8/1969 Bergstrom
3,620,399 A 11/1971 Rapeaud
3,836,033 A 9/1974 Podesta
3,981,412 A 9/1976 Asmus
4,093,094 A 6/1978 Smalley et al.
4,159,061 A 6/1979 Cornelius et al.
4,350,260 A 9/1982 Prueher
D266,649 S 10/1982 Plewes et al.
4,387,826 A 6/1983 Heubl
4,441,624 A 4/1984 Sokolowski
4,492,382 A 1/1985 Hounsel
D278,680 S 5/1985 Guzzini
4,561,557 A 12/1985 Park et al.
4,589,569 A 5/1986 Clements
4,600,111 A * 7/1986 Brown ..... A47G 19/2272 215/11.1
4,601,938 A * 7/1986 Deacon et al. ..... 428/153
D287,919 S 1/1987 Clements
D288,667 S 3/1987 Miner
D299,010 S 12/1988 Wall
4,796,774 A 1/1989 Nabinger
D308,169 S 5/1990 Auman
4,932,555 A 6/1990 La Barge
D320,559 S 10/1991 Olson
D324,105 S * 2/1992 Forrer ..... D24/196
5,147,058 A 9/1992 Seconde et al.
D332,379 S 1/1993 Murphy
D333,065 S 2/1993 Murphy
5,203,467 A 4/1993 Tucker
5,253,781 A 10/1993 Van Melle et al.
5,353,942 A 10/1994 Dominguez
D361,265 S 8/1995 Doxey
5,477,979 A 12/1995 Goessling et al.
5,542,922 A * 8/1996 Petterson et al. ..... 604/77
D394,184 S 5/1998 Demore
5,785,198 A 7/1998 Credle, Jr.
5,897,007 A * 4/1999 Schein et al. ..... 215/11.1
D417,845 S 12/1999 Sadlier et al.
6,010,029 A 1/2000 Wang
6,095,033 A 8/2000 Melton
D434,944 S * 12/2000 Randolph ..... D7/510
6,230,923 B1 * 5/2001 Hung ..... 220/703
6,325,236 B1 12/2001 Wong
6,371,315 B1 * 4/2002 Chien ..... 215/11.5
D470,009 S 2/2003 Turchi et al.
D476,891 S 7/2003 Clarke et al.
D485,179 S 1/2004 Kouri
D485,758 S 1/2004 Clarke et al.
6,679,397 B2 1/2004 Smith et al.
6,722,513 B1 4/2004 Flood et al.
6,732,875 B2 5/2004 Smith et al.
D495,600 S 9/2004 Kouri
D516,911 S 3/2006 Bloom et al.
7,172,084 B1 * 2/2007 Williams et al. ..... 215/11.1
D538,654 S 3/2007 Seidita
D545,618 S 7/2007 Zettle et al.
D546,463 S * 7/2007 Potvin ..... D24/197
D547,605 S 7/2007 Edelstein et al.
D555,795 S * 11/2007 Mallet ..... D24/197
D575,155 S 8/2008 Kinds et al.
D581,211 S 11/2008 Lapsker
D592,954 S 5/2009 Capretta et al.
7,537,129 B2 5/2009 Bayss et al.
7,556,172 B2 * 7/2009 Lane ..... 220/714
D612,237 S 3/2010 Richey
D614,952 S 5/2010 Caserta
7,780,023 B2 * 8/2010 Py ..... A61J 1/1406 215/11.1
D625,423 S * 10/2010 MacKay et al. ..... D24/197
D627,595 S * 11/2010 Jennings ..... D7/392.1
7,828,165 B2 * 11/2010 Brown et al. ..... 215/11.4
D629,298 S 12/2010 Wong
D634,200 S 3/2011 Taber et al.
D635,855 S 4/2011 Smith et al.
D637,079 S 5/2011 Brown et al.
7,959,029 B2 6/2011 Whitaker et al.
8,113,364 B1 * 2/2012 Asadi ..... 215/6
D679,948 S * 4/2013 Meyer et al. ..... D7/534
8,657,148 B2 * 2/2014 Krammes ..... A47G 19/2272 215/388
9,289,357 B2 * 3/2016 Itzek ..... A61J 11/0015
2003/0034351 A1 2/2003 Van Handel et al.
2004/0026354 A1 2/2004 Folchini et al.
2005/0145636 A1 * 7/2005 Albright ..... A47G 19/2272 220/714
2005/0184075 A1 * 8/2005 Belcastro ..... 220/714
2005/0258124 A1 11/2005 Brown et al.
2006/0124575 A1 6/2006 Mavin et al.
2006/0196442 A1 9/2006 Holms et al.
2007/0163984 A1 * 7/2007 Nguyen et al. ..... 215/11.3
2007/0283666 A1 * 12/2007 Py et al. ..... 53/425
2008/0011762 A1 1/2008 Boone
2008/0134714 A1 6/2008 Villanueva
2008/0237247 A1 * 10/2008 Mucci ..... B65D 3/06 220/713
2009/0050641 A1 2/2009 Ivey
2009/0057257 A1 * 3/2009 Marcus ..... A61J 9/08 215/11.6
2009/0101617 A1 * 4/2009 Viggiano ..... A47G 19/2266 215/228
2009/0283526 A1 11/2009 Pierce et al.
2010/0012657 A1 1/2010 Levey
2011/0011274 A1 1/2011 Thelen et al.
2011/0095038 A1 4/2011 Williams, Jr.
2011/0226802 A1 * 9/2011 Moore et al. ..... 222/1
2011/0259846 A1 10/2011 Diegel et al.
2011/0290817 A1 * 12/2011 Weiss ..... B65D 21/0222 220/780
2012/0091143 A1 * 4/2012 Hakim ..... 220/373
2013/0068715 A1 * 3/2013 Sakulsacha ..... 215/11.1

OTHER PUBLICATIONS

EIO, learn and grow, About Us, retrieved Apr. 14, 2013 from the internet: <URL: http://www.eiokidscup.com/pages/about-us>.
Holiday Themed Mason Jar Cups Tutorial, Crunchy Catholic Momma, date shown: Jul. 16, 2011, retrieved Jan. 29, 2013 from the internet: <URL: http://crunchycatholicmomma.blogspot.com/2011/07/holiday-themed-mason-jar-sippy-cups.html>.

* cited by examiner

A.

B.

A.

B.

A.

B.

A.

B.

A.

B.

A.

B.

LIDS FOR BEVERAGE CONTAINERS

This application claims the benefit of U.S. Provisional Application No. 61/630,616, filed Dec. 15, 2011, which is incorporated herein by reference in its entirety.

1.0 FIELD OF THE INVENTION

The invention relates to lids for beverage containers, preferably used with a compression system like a screw-on ring or a band.

2.0 BACKGROUND

Many consumers seek to reduce the amount of refuse they produce, or to reduce their carbon footprint, a measure of the total impact of their lifestyle. One way to reduce refuse and lower carbon footprint is to recycle. In addition, recycling allows customers to save money. These goals can be pursued by not throwing away jars. The re-using of jars as drinking cups allows a customer to save both money and help reduce their carbon footprint.

Owing in part to the increase of the "green" market, and in response to the need for alternatives to the disposable cup or bottle, there has been growing interest in re-usable drinking cups. Aluminum and steel premium water bottles and drinking cups are not a practical alternative because they cost considerably more than disposable cups. Canning jars have a widespread use in households worldwide and they are widely available. The most common class of canning jars is the ubiquitous Mason jar, discussed in John L. Mason's U.S. Pat. Nos. 22,129 and 22,186. Different variations of Mason jars have been used, and the term "Mason jar" has become a name for canning jars.

It would be desirable to have better ways to use jars and other containers for consuming beverages in order to use those jars and containers rather than adding them to refuse, and to save the cost of obtaining durable containers for beverage consumption. The present invention provides such technology by providing lids that can turn a jar, or a range of other containers, into drinking cups.

3.0 SUMMARY OF THE INVENTION

The current invention, in certain embodiments, relates to articles of manufacture and methods for using a container for consuming beverages. In certain embodiments, a device of the current invention is a lid that fits on an opening in a container holding a liquid. In certain preferred embodiments, a lid of the current invention comprises a hole to facilitate removing fluid from a container on which the lid is used. In certain other embodiments, a lid of the current invention comprises a second hole to facilitate air-flow through the lid, for example while liquid is removed from a container on which the lid is used through the first hole in the lid. In certain preferred embodiments, liquid can be removed from a container through a lid of the invention without removing the lid from the container, for example by drinking a liquid through a hole in the lid of the invention.

In certain preferred embodiments, a lid of the current invention is used with an attachment system, for example a screw-on compression system or an elastic or adhesive attachment system, to hold the lid in place on a beverage container, for example a canning jar. An attachment system for use with a lid of the invention, in certain embodiments, is capable of attaching a lid to a beverage container in a reversible manner, for example during use of the beverage container for consuming a beverage.

A lid of the current invention, in certain embodiments, can be used with a jar, a glass, a bottle, a cup, a mug, a beaker, a jug, a pot, a pitcher, a carafe, or any other container useful for a beverage.

4.0 BRIEF DESCRIPTION OF THE DRAWINGS

The present invention will be better understood by reading the Detailed Description of the various embodiments with reference to the accompanying figures.

Figure 17:
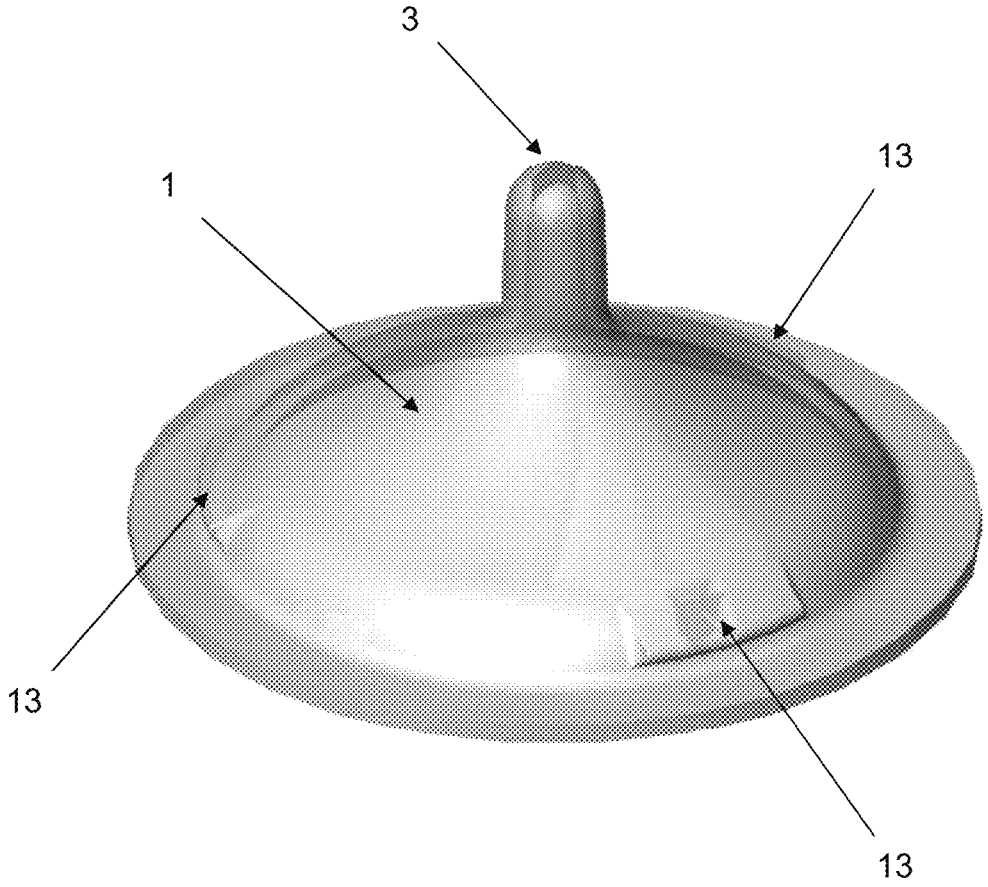

FIG. 17 shows a perspective view of a lid according to certain embodiments of the invention, which has the overall shape of a baby nipple, including a molded protrusion (1), an opening for removing liquid (3) and a nub to facilitate retention of the lid in a compression ring (for example a screw-on ring) of a beverage container (for example a jar) (13). In certain embodiments, one or more of the nubs contains a valve for facilitating air flow.

Figure 18:
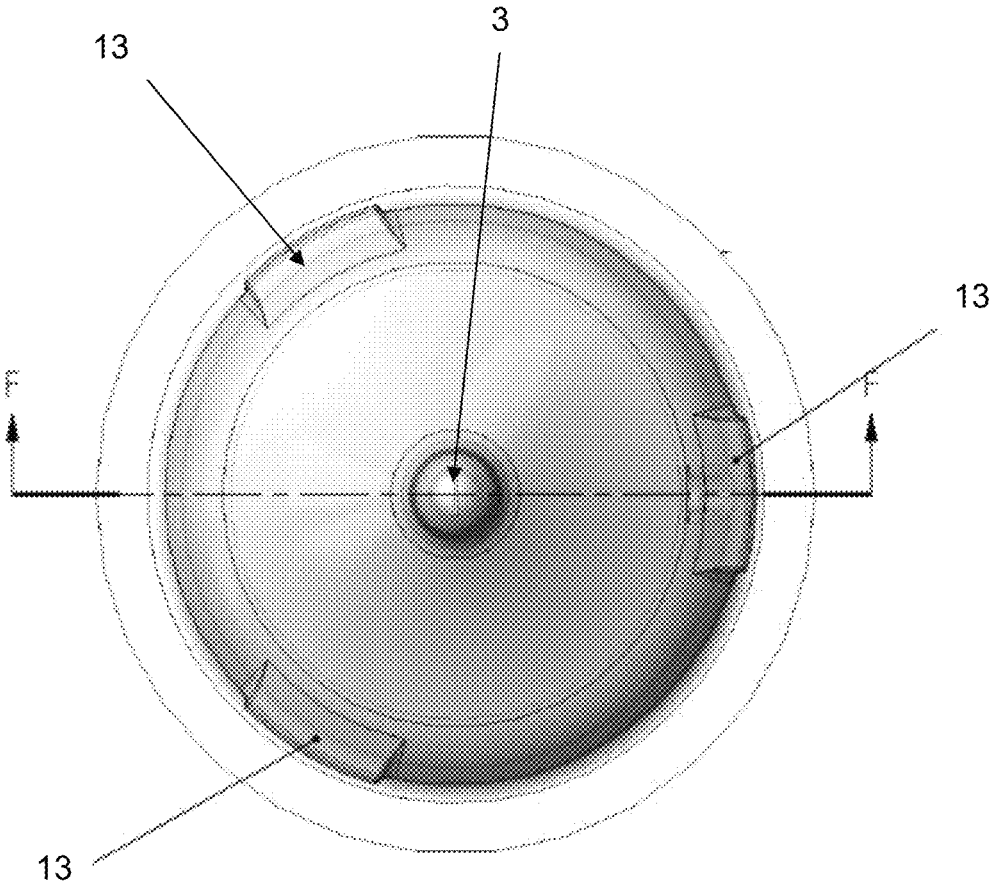

FIG. 18 shows a top view of a lid according to certain embodiments of the invention, which has the overall shape of a baby nipple, including an opening for removing liquid (3) and a nub to facilitate retention of the lid in a compression ring (for example a screw-on ring) of a beverage container (for example a jar) (13). In certain embodiments, one or more of the nubs contains a valve for facilitating air flow. Along the line F-F is a cross section shown in FIG. 19.

Figure 19:
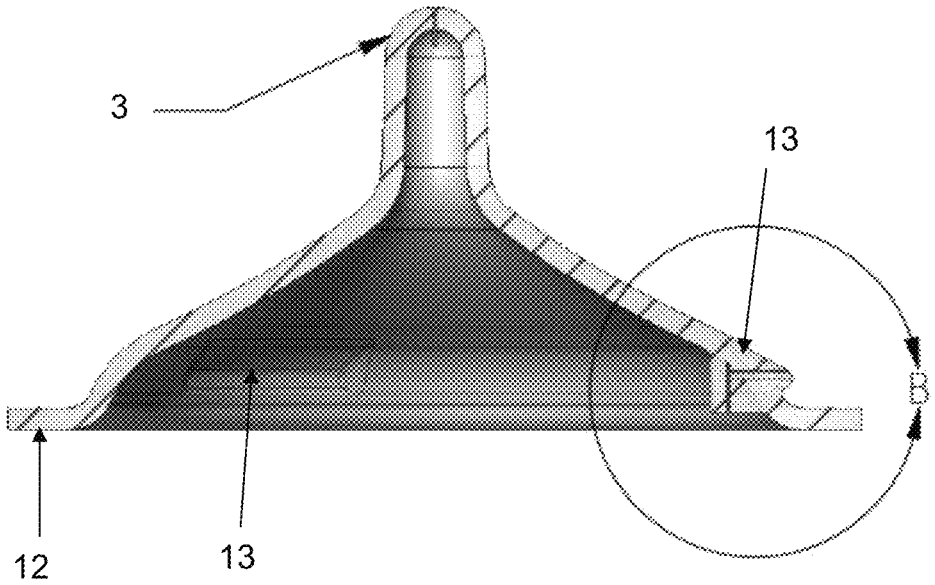
Figure 19:
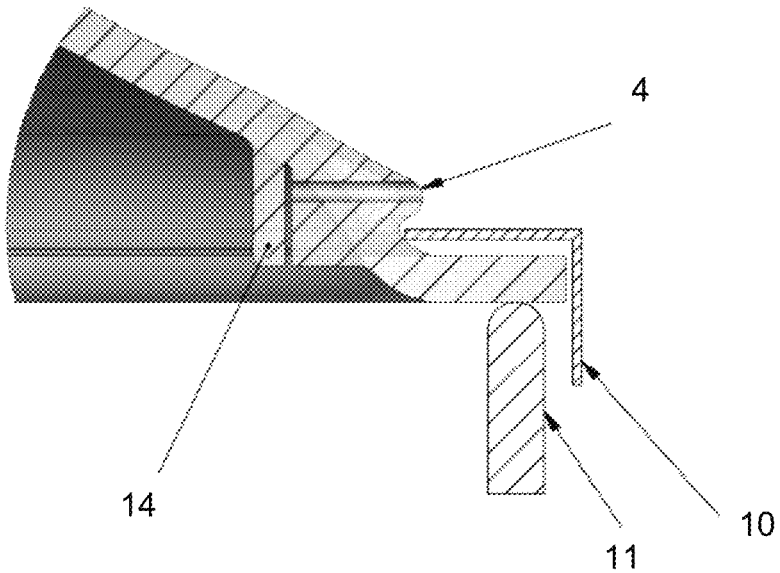

FIG. 19 shows a cross section view along line F-F in FIG. 18(A), and an enhanced detail view of a valve to facilitate air flow (B), of a lid according to certain embodiments of the invention, which has the overall shape of a baby nipple, including an opening for removing liquid (3) and an opening for facilitating air flow (4), a screw-on ring (10), a jar (or vessel) (11), a bottom plane (12), a nub to facilitate retention of the lid in a compression ring (for example a screw-on ring) of a beverage container (for example a jar) (13), and a flap to prevent liquid from exiting (14).

Figure 20:
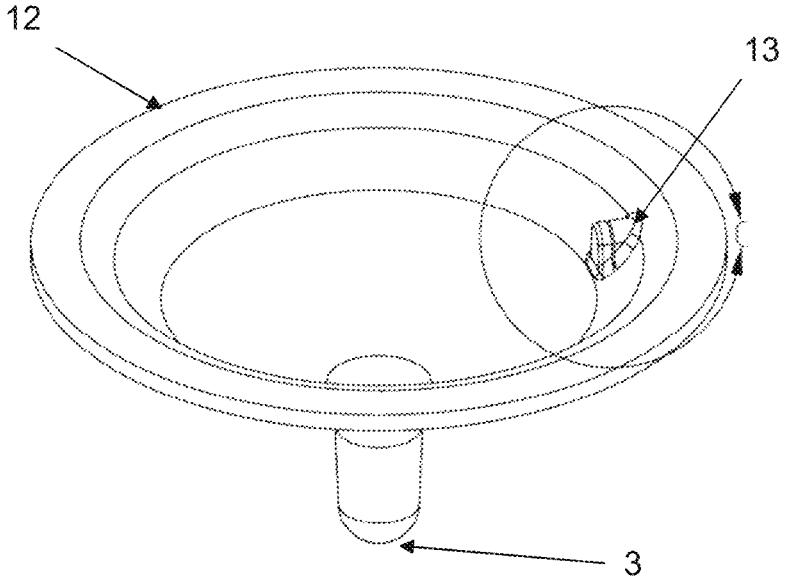
Figure 20:
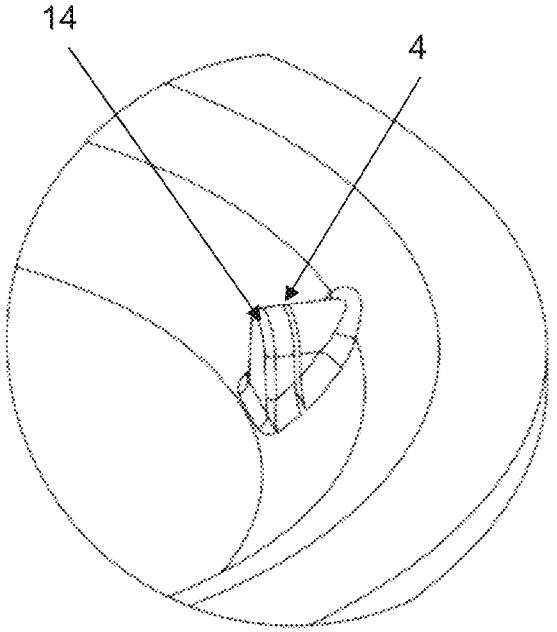

FIG. 20 shows a bottom perspective view (A), and an enhanced detail view of a valve to facilitate air flow (B), of a lid according to certain embodiments of the invention, which has the overall shape of a baby nipple, including an opening for removing liquid (3) and an opening for facilitating air flow (4), a bottom plane (12), a nub to facilitate retention of the lid in a compression ring (for example a screw-on ring) of a beverage container (for example a jar) (13), and a flap to prevent liquid from exiting (14). In certain embodiments, one or more of the nubs contains a valve for facilitating air flow.

Figure 21:
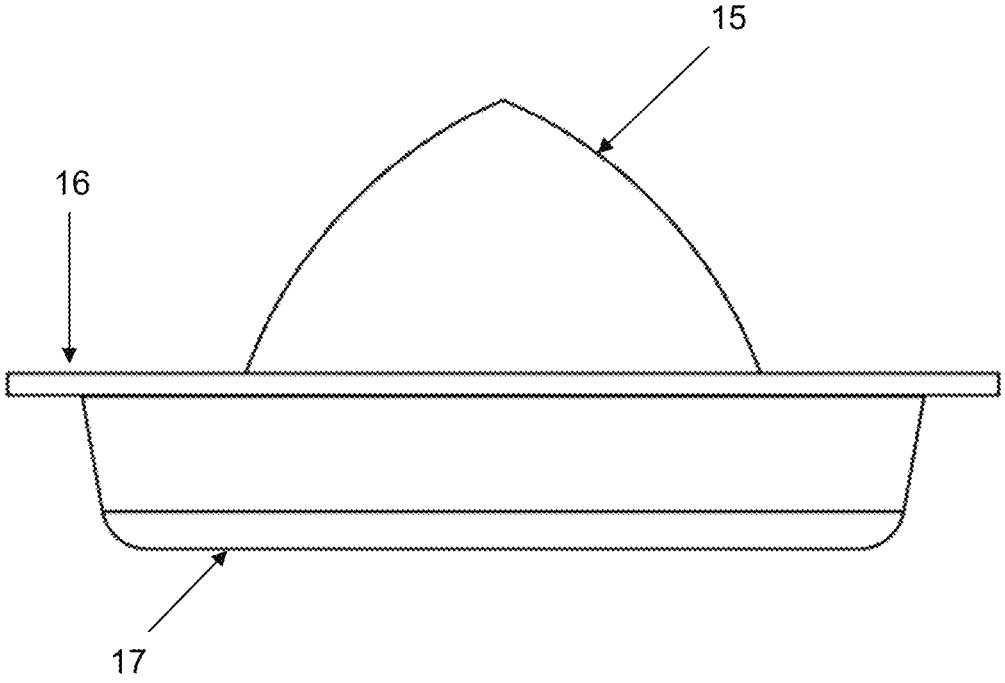
Figure 21:
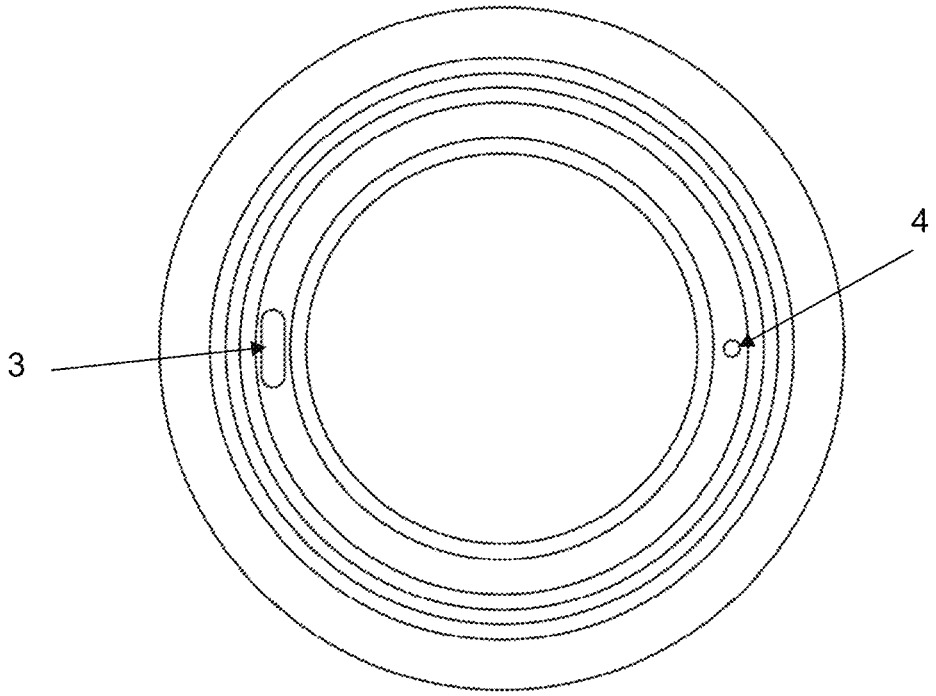

FIG. 21 shows a side view (A) and a top view (B) of a lid according to certain embodiments of the invention, including an opening for removing liquid (3) and an opening for facilitating air flow (4), a protrusion for generating juice, for example, from fruit (15) (a fruit juicer), an upper side of the lid when the protrusion is used to generate juice (16), and an upper side of the lid when the lid is used to consumer a beverage (17). When the protrusion (15) is used to generate juice, it may enter a container on which the lid is used through a hole (3).

Figure 22:
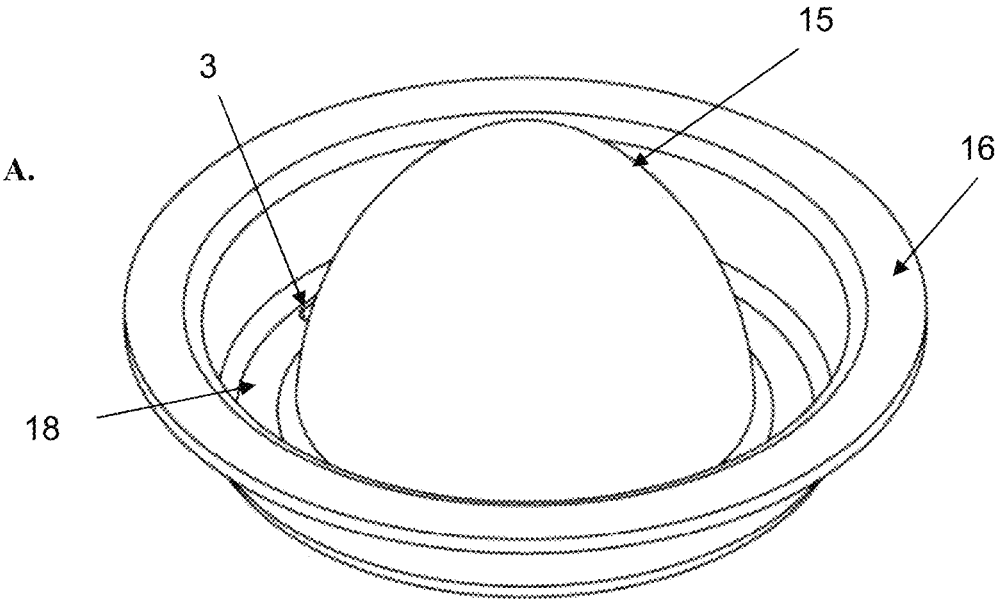
Figure 22:
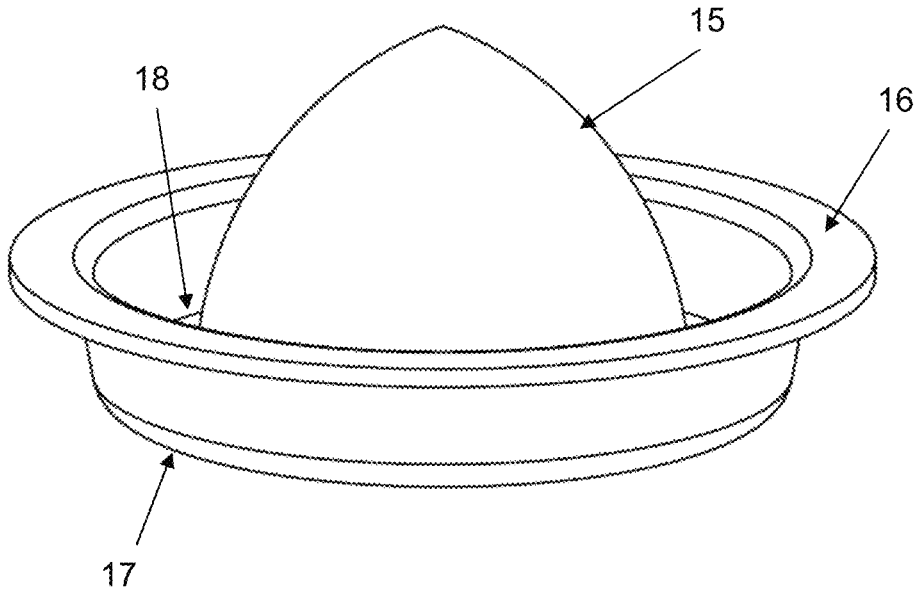

FIG. 22 shows two perspective views (A and B) of a lid according to certain embodiments of the invention, including an opening for removing liquid (3), a protrusion for generating juice, for example, from fruit (15), an upper side of the lid when the protrusion is used to generate juice (16), an upper side of the lid when the lid is used to consume a beverage (17), and a recess for collecting juice (18). When the protrusion (15) is used to generate juice, it may leave the recess (18) and enter a container on which the lid is used through a hole (3).

Figure 23:
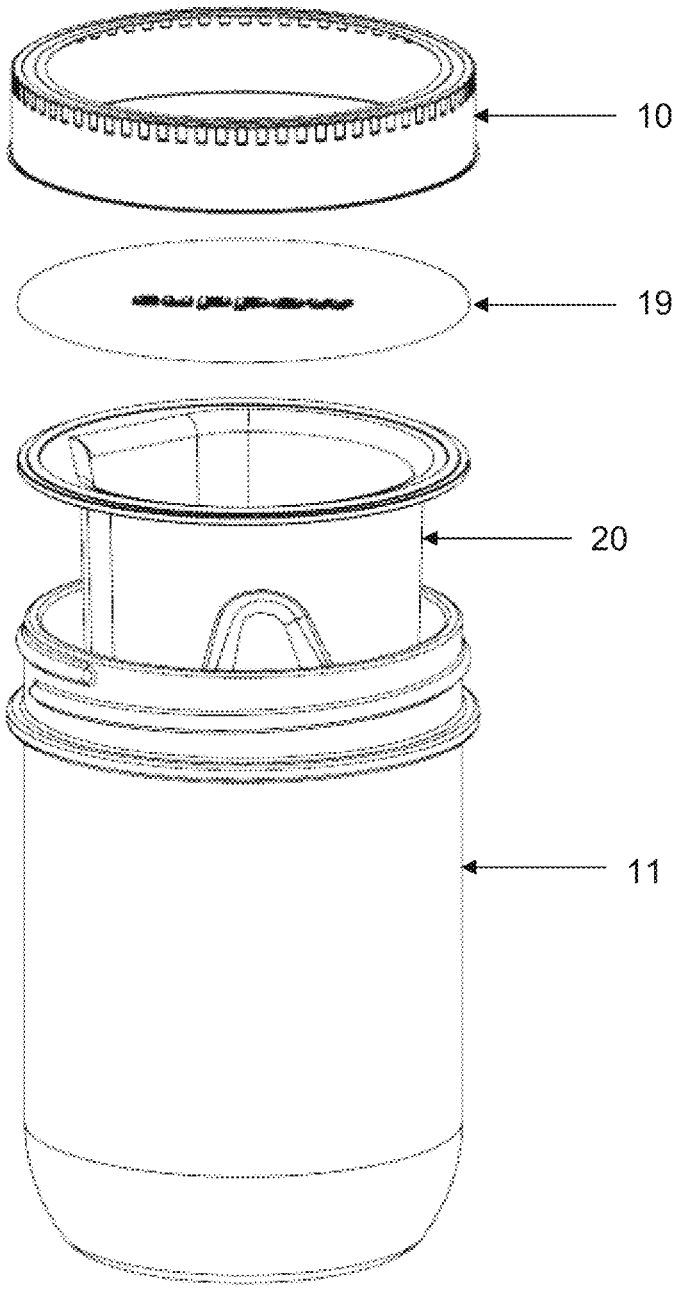

FIG. 23 shows a bento box separator according to certain embodiments of the invention used with a jar or vessel, including a screw-on ring (10), a jar (or vessel) (11), a metal seal disc (19), and a bento box separator according to certain embodiments of the invention (20).

Figure 24:
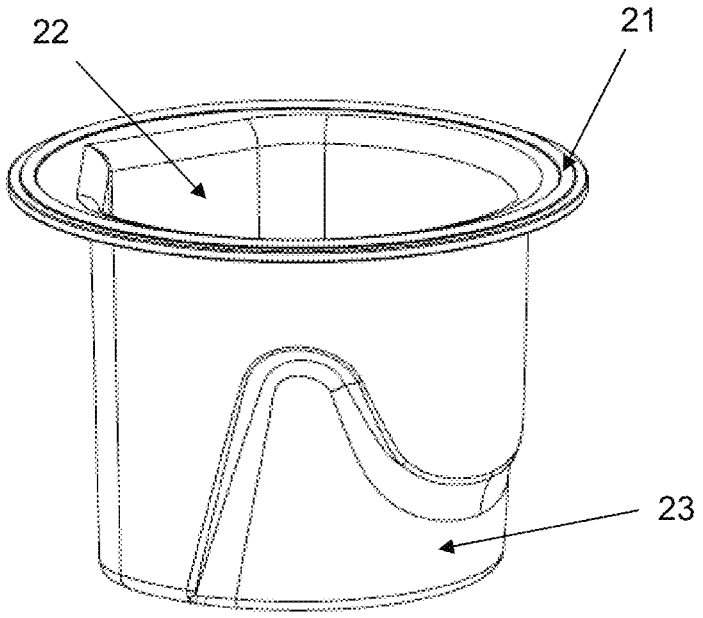
Figure 24:
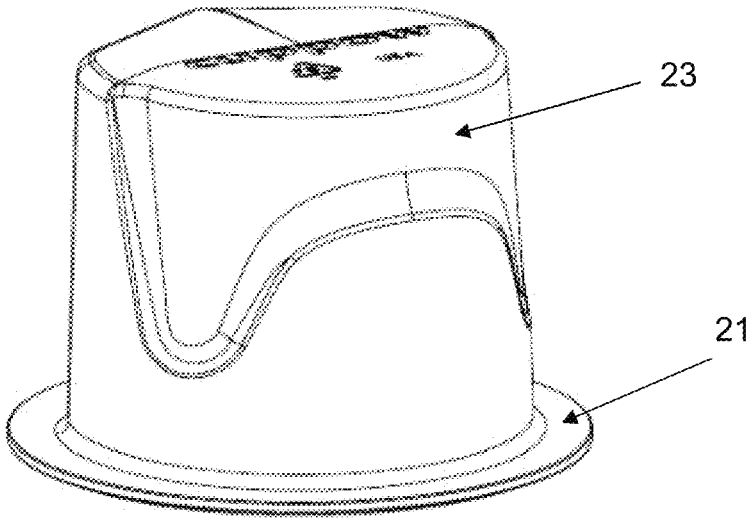

FIG. 24 shows a perspective view of a bento box separator according to certain embodiments of the invention, in an upside up (A) and bottom up (B) position, including a collar with nub (21), an interior (22), and a contoured region (23).

Figure 25:
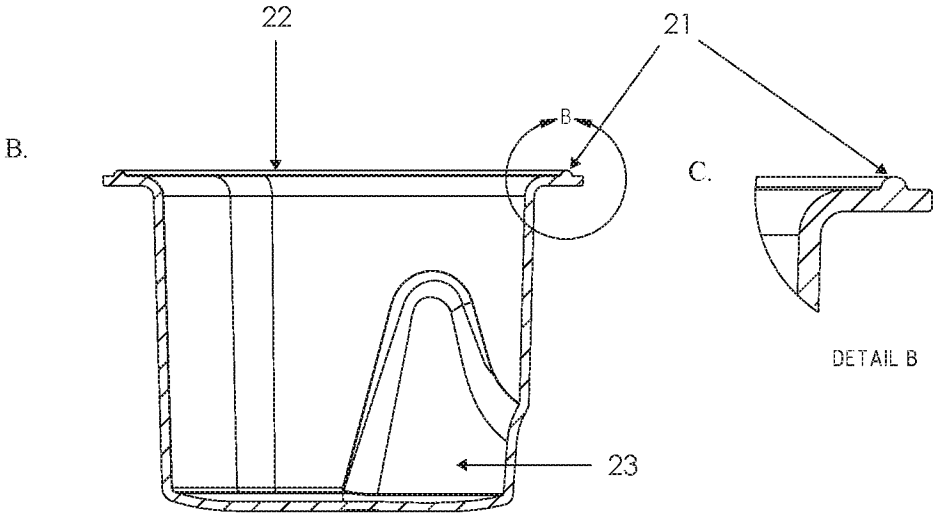

FIG. 25 shows a side view of a bento box separator according to certain embodiments of the invention, showing the complete separator (A), a cross section along the A-A line (B), and an enhanced detail view of the rim (C), including a collar with nub (21), an interior (22), and a contoured region (23).

Figure 26:
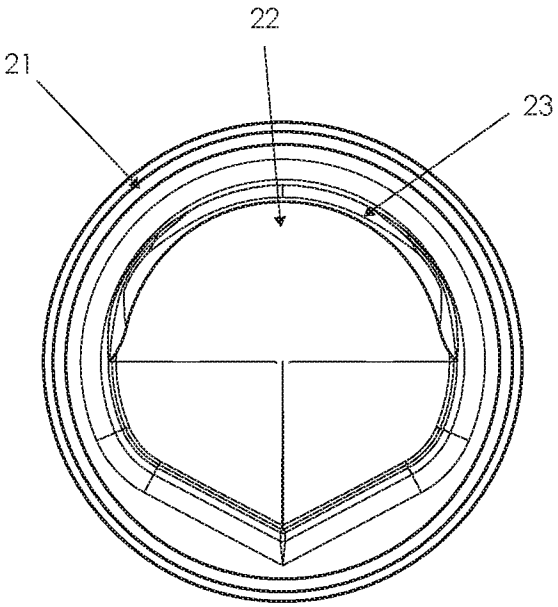

FIG. 26 shows an upside view of a bento box separator according to certain embodiments of the invention, including a collar with nub (21), an interior (22), and a contoured region (23).

5.0 DETAILED DESCRIPTION OF THE INVENTION

The present invention relates to lids for food containers, preferably containers for liquids for consumption by people. In certain preferred embodiments, a lid of the current invention fits onto an opening in a container so that it seals the opening. In certain other embodiments, a lid of the current invention comprises a hole for removing liquid from a container, for example, a hole for drinking, for pouring, or for inserting a straw. In certain other embodiments, a lid of the invention comprises a hole for allowing air to enter and escape the container on which the lid is used. In certain preferred embodiments, a lid of the current invention is attached to a container through some means of attachment suitable for the container, for example, a screw on ring, an elastic band, or some other means. In certain preferred embodiments, a lid of the current invention is usable for food and beverages for human consumption. In certain other embodiments, a lid of the current invention is useful for use by an animal, for example, a small animal, a pet, or a farm animal. A lid of the current invention can be used with any container useful for holding liquids for consumption, for example, a jar, a glass, a bottle, a cup, a mug, a beaker, a jug, a pot, a pitcher, a carafe, or any other container useful for a beverage.

In certain embodiments of the invention, a replacement lid is provided, which is held by a screw-on compression band to the top of a Mason or canning jar. This application describes a novel device which replaces the removable disc in the typical two-piece lid or cover assembly for a canning jar, with a ergonomically designed spout and opening, converting the jar and cover assembly into a portable drinking vessel. The device utilizes the locating and securing technique provided by the screw-on compression band, much like the standard disc cover for the glass canning jar or Mason jar.

While the replacement lid, in its preferred embodiments, relates to drinking beverages such as coffee or iced tea from a Mason jar, the replacement lid has broader applications. The present invention encompasses a novel method for a drinking cup, for Mason jars and canning jars in general. Additionally the present invention relates to a novel construction of lids for beverages and novel methods for using the lid with different types of jars and for different beverages. The novel construction of the replacement lid provides other advantages that are not necessarily related to re-using Mason jars, as will be evident from the description set forth below.

The present invention relates to replacement lids for jars, especially lids for jars in home use, and particularly to lids for Mason jars where the lid allows the user to drink from the jar by sipping or pouring from an open portion of the lid. Typically jars include jars packed with fruits or vegetable, a particular version of a jar is called the Mason jar, a jar that is commonly found with a threaded lip for screwing on a metal lid with a threaded lid fastener. The lid fastener screws to the top of the jar and compresses the metal lid to the lip of the Mason jar, sealing the contents inside. The metal lid fastener may be of a variety of designs, from clamping to screw style, with and without a rubber gasket. Canning jars come in two standard sizes, Wide Mouth, and Regular Mouth. These two standard sizes are used in the United States and are also used in other countries. Jar sizes are determined by the internal diameter of the mouth opening of the jar. Canning jar size is independent from the jar capacity. Canning jars are available in a variety of different capacities, making them ideal for transporting a variety of different types of beverages and foods.

A lid of the current invention, in certain embodiments, is placed on top of the metal seal disc that comes with a beverage container, for example a canning jar, so that the stack would be, from the bottom, a canning jar, a metal disc, a lid of the invention, and then a compression ring, whereby the beverage is sealed, for example, for travel. In this embodiment, when a user wants to open the jar and drink using the lid of the invention, the metal seal disc is removed.

Commonly used canning jars with a threaded lip have a screw-on ring compression system used to secure a lid in place. These jars make ideal portable containers as they are relatively abundant, cheap, thermo-resistant, and made from food-grade recyclable glass. Using these unmodified containers for beverages is difficult because the screw clamp must be removed and resealed every time the user wishes to drink. The threads on the outer surface of the canning jar interfere with a person being able to make a watertight seal with their bottom lip because they are not smooth, and not comfortable to drink from. Further, it is difficult to drink from these containers because their opening, or mouth, tends be quite wide.

The present invention provides an improvement on the lid of the jar, by replacing the conventional lid with a version designed with an opening that allows a person to drink, eat or pour from the jar. In one example the replacement lid of the invention allows the jar to be an environmentally friendly alternative to disposable coffee cups, the jar is re-used to drink coffee from a coffee sipping lid fixed to the top of the jar by the lid fastener normally used on a Mason jar.

In certain embodiments, the invention provides bento box separators, for example for use with container, for example containers like jars. A bento box separator, in certain embodiments, is inserted into a beverage container, for example a jar, so that it separates the contents of the separator from the contents of the remainder of the beverage container. A bento box separator can be used, for example, to maintain different components in a beverage container separated, for example to separate a dry component from a wet component, or a sweet component from a non-sweet component.

In certain embodiments, a lid of the invention is in the shape of a baby nipple, preferably with a hole for removing liquid at the tip. In certain embodiments, a nipple shaped lid of the invention includes a hold to facilitate the equilibration of air, for example to allow air to enter a beverage container while fluid is removed.

In certain embodiments, a lid of the invention includes a protrusion that may be used to obtain juice from fruit or vegetables, for example by pushing the fruit or vegetable onto the protrusion. A lid according to these certain embodiments can be referred to as a juicer lid or fruit juicer lid or citrus juicer lid. In certain embodiments, the protrusion of a juicer lid is surrounded by a recess where juice may collect, preferably with a hole at the bottom of the recess. Surrounding the recess of a juicer lid, in certain embodiments, is a collar that may rest in the opening of a beverage container on which the juicer lid is used, and which may form a seal with the beverage container. In certain embodiments, a juicer lid may be placed on a beverage container with the protrusion pointing outward for generating juice. In certain embodiments, a juicer may be placed on a beverage container with the protrusion pointing inward the container, so that the opposite side, without a protrusion, is exposed, allowing the removal of fluid from the container through a hole, for example by drinking from the hole. In certain embodiments, equilibration of air is facilitated through a second hole. In certain embodiments, a juice lid of the invention may be secured onto a beverage container in either orientation, protrusion outward or inward, for example through a screw on ring.

Figure 1:
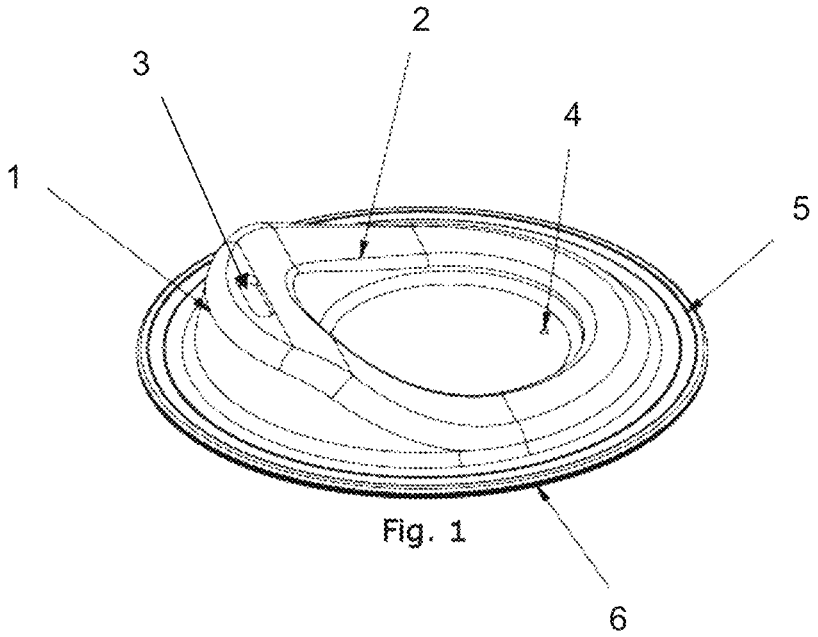
FIG. 1 shows a perspective view of a lid according to certain embodiments of the invention, including a molded protrusion (1 and 2), an opening for removing liquid (3) and an opening for facilitating air flow (4), a ridge (5), and a fat lip (6) around the bottom plane of the lid.
Figure 8:
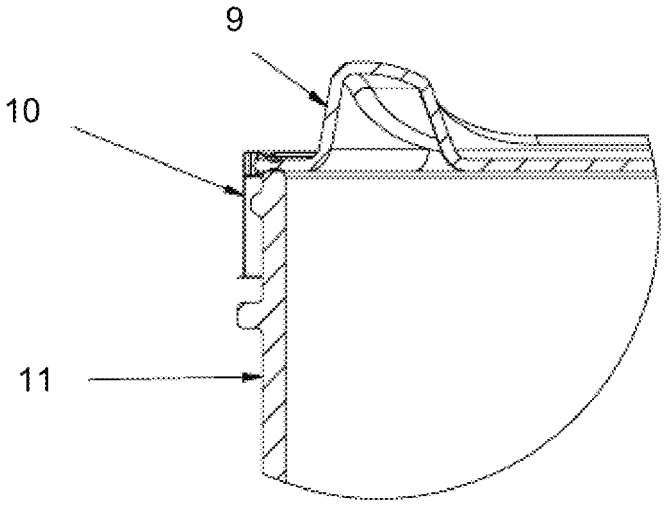
FIG. 8 shows a detailed cross-sectional view of a ridge of a lid according to certain embodiments of the invention, as shown in the encircled area in FIG. 7, and in combination with a jar and the screw-on ring. The numerals identify a lid (9), a screw-on ring (10), and a jar (11).

Lids according to certain embodiments of the current invention are further exemplified in the figures. In FIG. 1 there is shown a lid according to certain embodiments that is of an overall circular shape with a molded protrusion 1 and 2 at a non-parallel angle away from the plane with the fat-lip 6, where it can be secured with a screw clamp 10, as shown in FIG. 8. A flat lip 6 extends around the periphery of the lid depending from a circumferential ridge 5. A lid according to the invention may be made of metal, plastic, or any other sufficiently durable material, for example a one piece thermoplastic structure or some other thermo-formable material suitable for use with beverages. The opening 3 is used to remove liquid from the container and the opening 4 facilitates equilibration of air in the vessel. In certain embodiments, a lid of the current invention does not have a protrusion 2, an opening to facilitate equilibration of air 4, a fat-lip 6, and/or a circumferential ridge 5.

Figure 2:
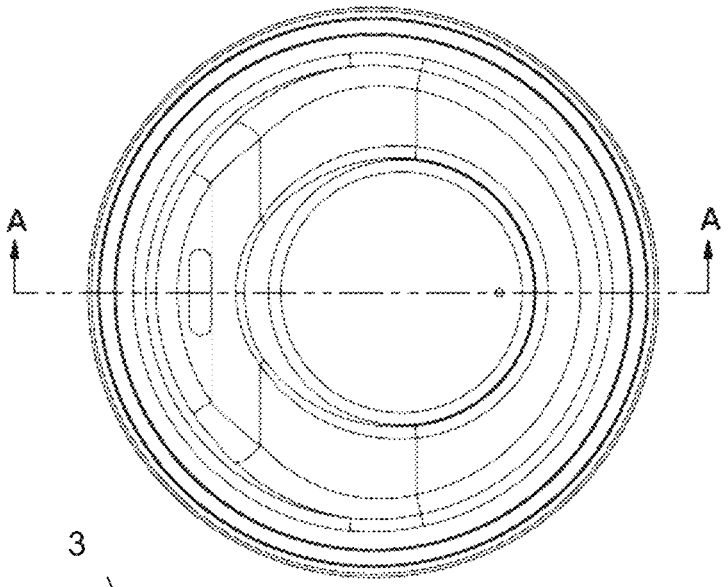
FIG. 2 shows a top view of a lid according to certain embodiments of the invention. Along the line A-A is a cross section shown in FIG. 3.
Figure 3:
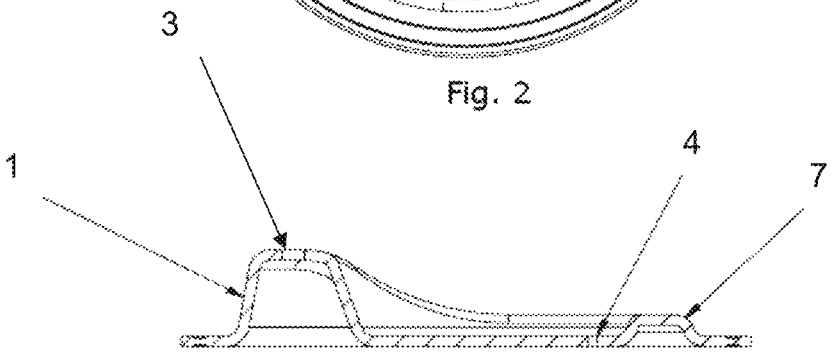
FIG. 3 shows a cross section of a lid according to certain embodiments along the line A-A shown in FIG. 2. Also shown are a molded protrusion (1), an opening for removing liquid (3) and an opening for facilitating air flow (4), and a lower raised annular section (7).
Figure 4:
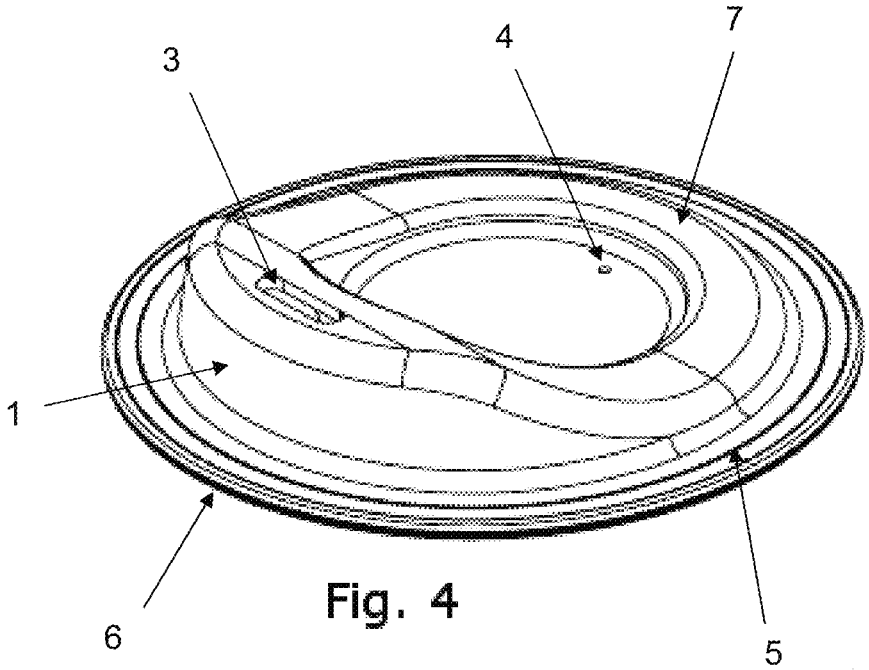
FIG. 4 shows another perspective view of a lid according to certain embodiments of the invention, including a protrusion (1), an opening for removing liquid (3) and an opening for facilitating air flow (4), a ridge (5), a fat lip (6) around the bottom plane of the lid, and a lower raised annular section (7).

FIG. 2 shows a lid according to certain embodiments; the transverse line A is where the cross section of the lid is shown in FIG. 3. The lid of FIG. 3 again shows the front facing spout 1 in cross-section, tapering along the outer edge of the lid to a lower raised annular section 7 of the lid. FIG. 4 shows another view of a lid according to certain embodiments of the invention. Shown are a molded protrusion, a hole for removing fluid 3, a hole to facilitate air flow and equilibration 4, a ridge 5, a fat lip 6, and a lower raised annular section 7. In certain embodiments, a lid of the current invention does not have a raised annular section 7.

Figure 5:
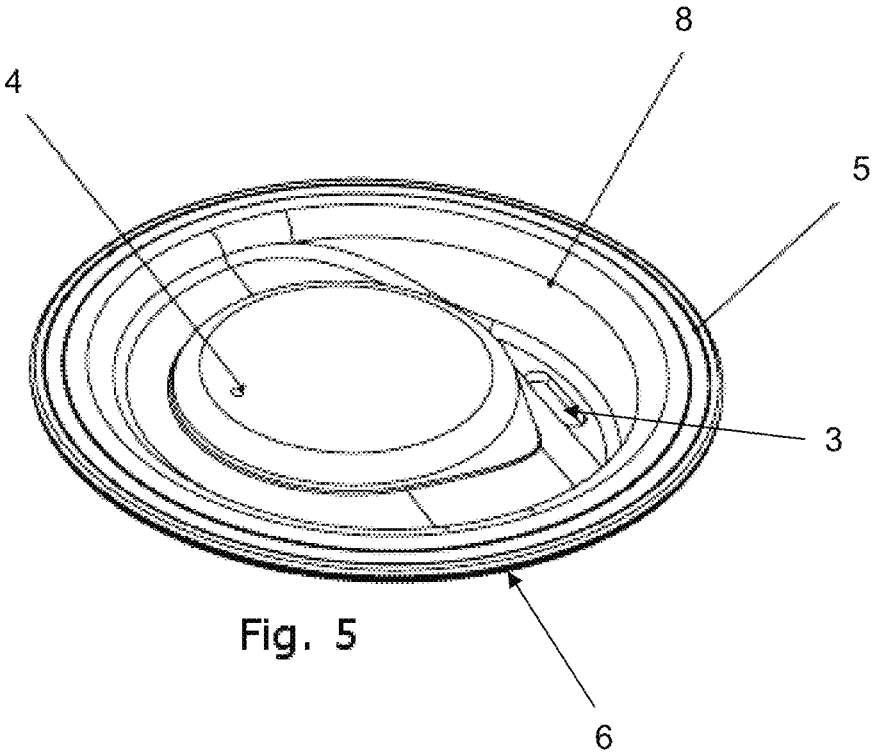
FIG. 5 shows an underside view of a lid according to certain embodiments of the invention, including an opening for removing liquid (3) and an opening for facilitating air flow (4), a ridge (5), a fat lip (6) around the bottom plane of the lid, and a steeper ridge (8).
Figure 6:
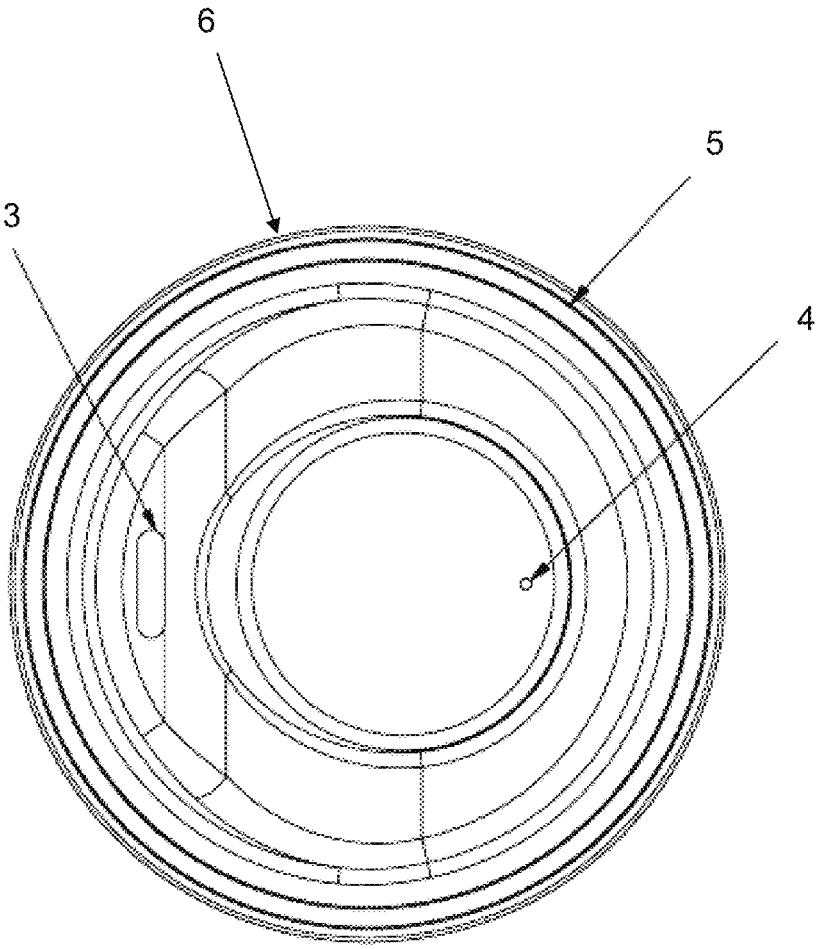
FIG. 6 shows a top down view of a lid according to certain embodiments of the invention, including an opening for removing liquid (3) and an opening for facilitating air flow (4), a ridge (5), and a fat lip (6) around the bottom plane of the lid.

FIG. 5 shows the underside of a lid according to certain embodiments of the invention with a hole for removing fluid 3, a hole to facilitate air flow 4 for equilibration, a ridge 5, a fat lip 6, and a steeper ridge 8 (steeper than ridge 5). The equilibration hole 4 is shown in the centrally located depression of the lid. The ridge 8 demarks an increase in the angle between the spout and the immediately adjacent circumference of the lid, while the ridge 5 demarks the transition to a portion of the lid specifically designed to engage the lip of a jar while in compression from a screw-on ring. The drinking spout on the lid features an opening 3 from which a person can consume liquid. FIG. 6 shows the upper side of a lid according to certain embodiments of the invention with a hole for removing liquid 3, a hole for air flow 4, a ridge 5, and a fat lip 6.

Figure 7:
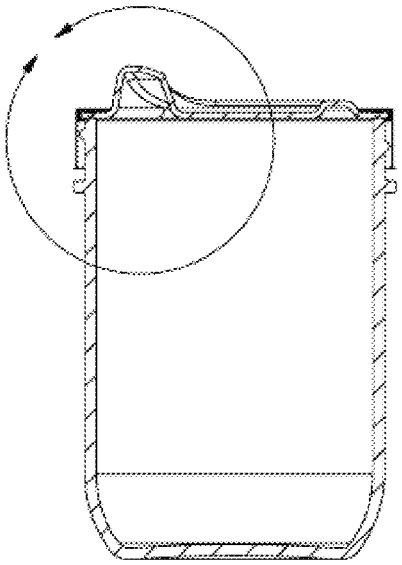
FIG. 7 shows a lid according to certain embodiments of the invention in cross section and attached to a jar by a screw-on ring. The area highlighted by a circular arrow is enlarged and shown in FIG. 8.
Figure 9:
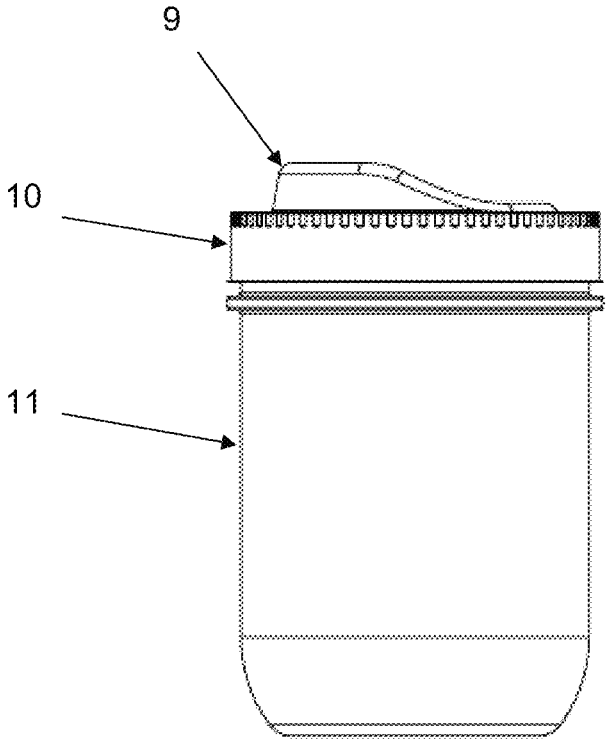
FIG. 9 shows a lid according to certain embodiments of the invention (9) used on a jar (11) with a screw-on ring (10).
Figure 10:
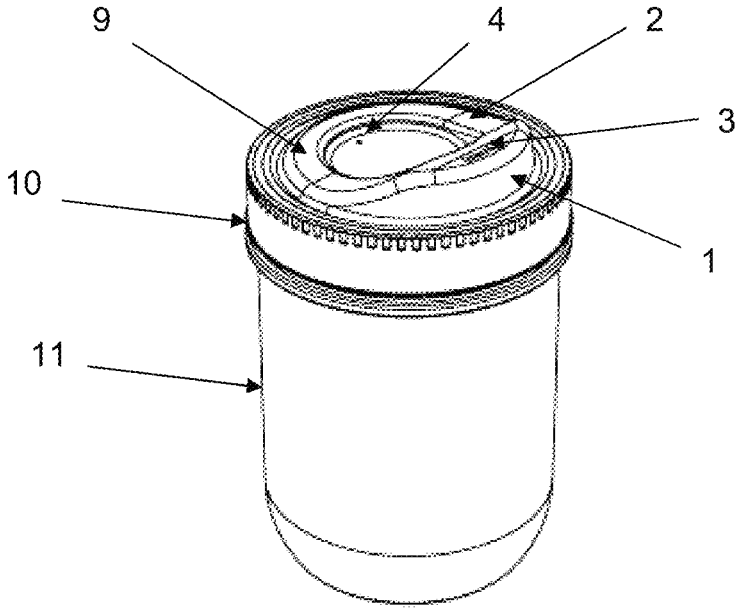
FIG. 10 shows as perspective view of a lid according to certain embodiments of the invention (9) used on a jar (11) with a screw-on ring (10). Also shown are a molded protrusion (1 and 2), and an opening for removing liquid (3) and an opening for facilitating air flow (4).
Figure 11:
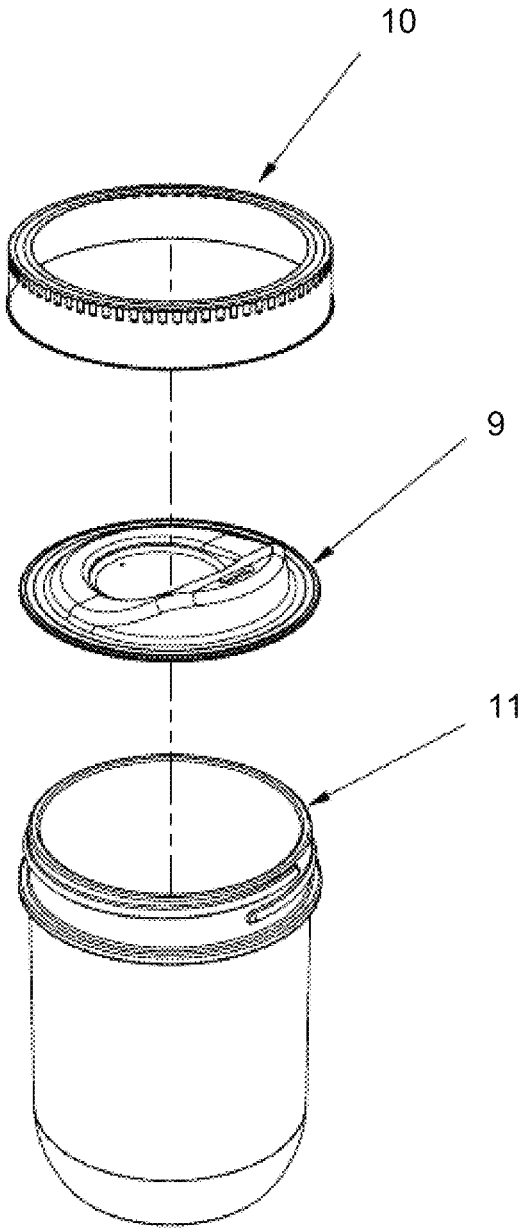
FIG. 11 shows an exploded diagram with an order of assembly of a lid according to certain embodiments of the invention (9) with a screw-on ring (10) and a jar (or vessel) (11).

FIG. 7 shows a lid according to certain embodiments with a completely assembled jar in cross section. FIG. 8 shows a detailed view of the encircled area of FIG. 7, including a lid 9, a screw-on compression ring 10, and a jar 11. FIGS. 9 and 10 show lids 9 according to certain embodiments on a jar 11 with a screw-on ring 10. FIG. 10 also shows a protrusion 1 and 2, a hole for removing liquid 3, and a hole to facilitate air flow 4. FIG. 11 illustrates the assembly of a lid according to certain embodiments 9 on a jar (or vessel) 11 with a screw-on lid 10.

Figure 12:
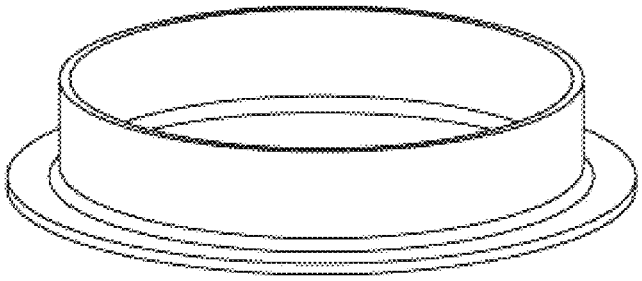
FIG. 12 shows a lid according to certain embodiments of the invention, which is a no spill lid. When secured to a jar, the lip of the lid according to this embodiment of the invention extends beyond the rim of the jar for easy pouring.

FIG. 12 illustrates a lid according to certain embodiments of the invention with a lip, for example, ideal for pouring liquids from a vessel such as a Mason jar. Many contemporary jars have measuring marks along the outside of the jars allowing the jar to also be used as a measuring cup, the problem is that pouring from a normal jar without the extended lip results in liquids dribbling down the side of the jar.

Figure 13:
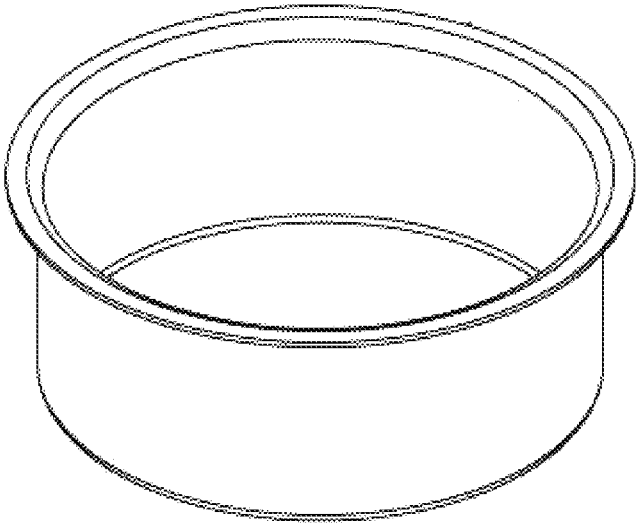
FIG. 13 shows a bento box separator according to certain embodiments of the invention for a jar or vessel.

FIG. 13 illustrates a lid according to certain other embodiments of the invention for use as a watertight container for "bento box" lunches. Bento is a single-portion takeout or home-packed meal common in Japanese cuisine. A Bento Box separates the different portions of the meal into different compartments. In this embodiment of the invention, the top portion would be able to contain some dry ingredients such as rice or dried fruit, while the bottom portion may contain a liquid such as soup, or more substantive wet food such as chili or gumbo.

Figure 14:
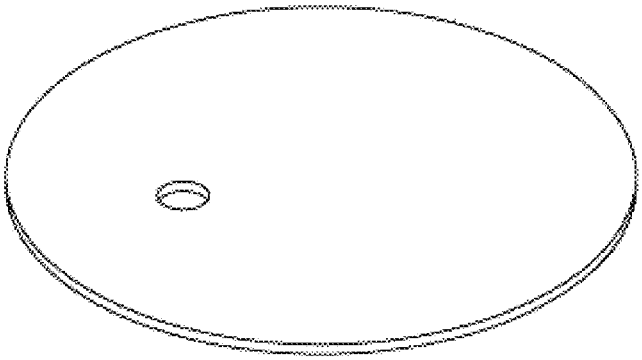
FIG. 14 shows are lid according to certain embodiments of the invention with a hole for a straw.

FIG. 14 illustrates another example according to certain embodiments of the invention, useful for drinking iced coffee, iced tea, sodas or other beverages with a straw. A lid according to this embodiment of the invention features an opening for a straw to be inserted through the lid.

Figure 15:
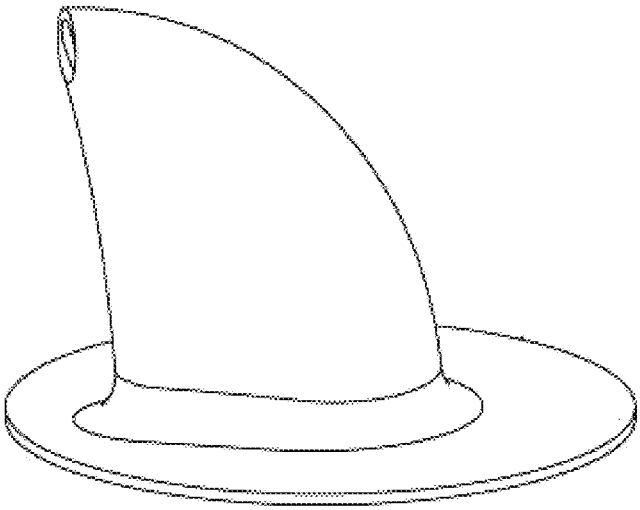
FIG. 15 shows are lid according to certain embodiments of the invention with a speed pourer.

FIG. 15 illustrates a lid according to certain embodiments with a speed pourer to allow the user to quickly dispense liquids, typically alcoholic beverages or a drink mixer directly from the jar without removing the lid each time the user wants to pour.

Figure 16:
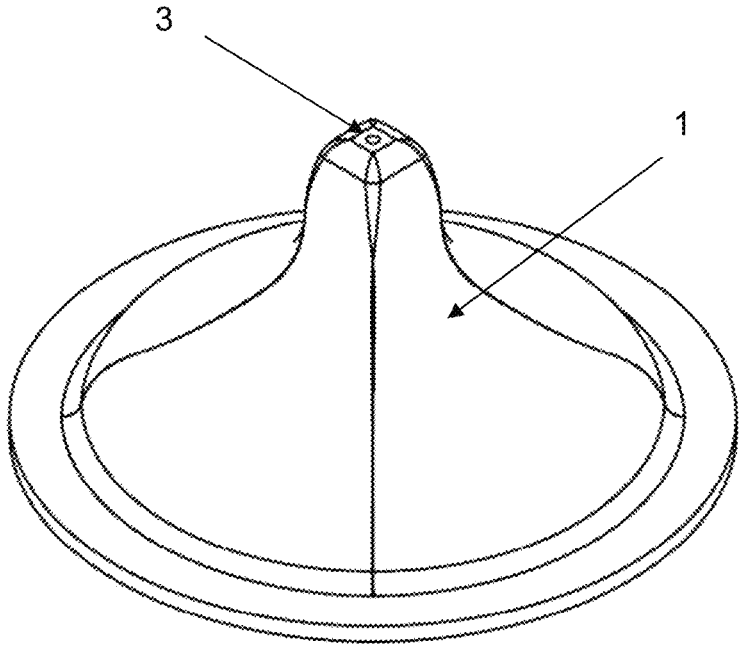
FIG. 16 shows a perspective view (A) and a side view (B) of a lid according to certain embodiments of the invention, which has the overall shape of a baby nipple, including a molded protrusion (1), an opening for removing liquid (3) and a bottom plane (12).
Figure 16:
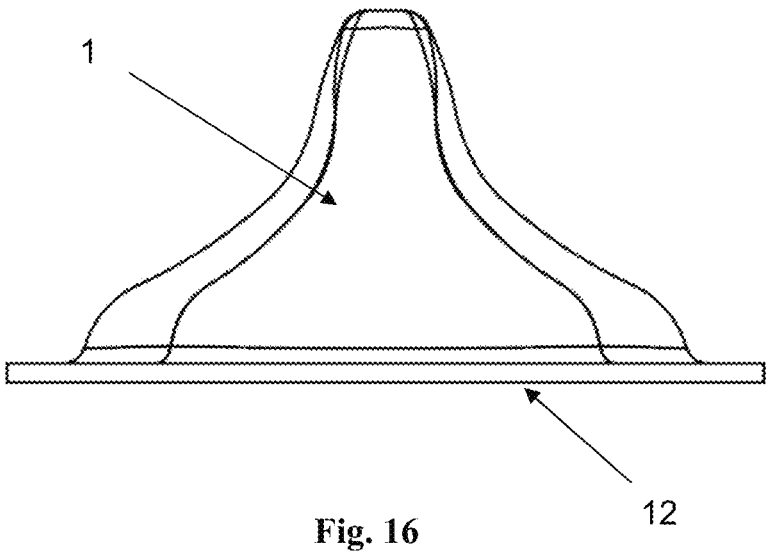

FIG. 16 illustrates a lid according to certain embodiments of the invention with the overall shape of a baby nipple. The lid in this embodiment includes a molded protrusion (1) with an opening for removing liquid (3). The lid further includes a bottom plane (12).

FIG. 17 illustrates a lid according to certain embodiments of the invention with the overall shape of a baby nipple. The lid in this embodiment includes a molded protrusion (1), an opening for removing liquid (3) and a nub (three nubs are shown in this example) to facilitate retention of the lid in a compression ring (for example a screw-on ring) of a beverage container (for example a jar) (13). In certain embodiments, one or more of the nubs contains a valve for facilitating air flow.

FIG. 18 illustrates a lid according to certain embodiments of the invention with the overall shape of a baby nipple. The lid in this embodiment includes an opening for removing liquid (3) and a nub to facilitate retention of the lid in a compression ring (for example a screw-on ring) of a beverage container (for example a jar) (13). In certain embodiments, one or more of the nubs contains a valve for facilitating air flow. Along the line F-F is a cross section shown in FIG. 19.

FIG. 19 illustrates a cross section view along line F-F in FIG. 18(A), and an enhanced detail view of a valve to facilitate air flow (B), of a lid according to certain embodiments of the invention with the overall shape of a baby nipple. The lid in this embodiment includes an opening for removing liquid (3) and an opening for facilitating air flow (4), a screw-on ring (10), a jar (or vessel) (11), a bottom plane (12), a nub to facilitate retention of the lid in a compression ring (for example a screw-on ring) of a beverage container (for example a jar) (13), and a flap to prevent liquid from exiting (14).

FIG. 20 illustrates a bottom perspective view (A), and an enhanced detail view of a valve to facilitate air flow (B), of a lid according to certain embodiments of the invention with the overall shape of a baby nipple. The lid in this embodiment includes an opening for removing liquid (3) and an opening for facilitating air flow (4), a bottom plane (12), a nub to facilitate retention of the lid in a compression ring (for example a screw-on ring) of a beverage container (for example a jar) (13), and a flap to prevent liquid from exiting (14). In certain embodiments, one or more of the nubs contains a valve for facilitating air flow.

FIG. 21 illustrates a side view (A) and a top view (B) of a lid according to certain embodiments of the invention. The lid in this embodiment includes an opening for removing liquid (3) and an opening for facilitating air flow (4), a protrusion for generating juice, for example, from fruit (15) (a fruit juicer), an upper side of the lid when the protrusion is used to generate juice (16), and an upper side of the lid when the lid is used to consumer a beverage (17). When the protrusion (15) is used to generate juice, it may enter a container on which the lid is used through a hole (3).

FIG. 22 illustrates two perspective views (A and B) of a lid according to certain embodiments of the invention. The lid in this embodiment includes an opening for removing liquid (3), a protrusion for generating juice, for example, from fruit (15), an upper side of the lid when the protrusion is used to generate juice (16), an upper side of the lid when the lid is used to consume a beverage (17), and a recess for collecting juice (18). When the protrusion (15) is used to generate juice, it may leave the recess (18) and enter a container on which the lid is used through a hole (3).

FIG. 23 illustrates a bento box separator according to certain embodiments of the invention used with a jar or vessel. The bento box separator (or bento separator) in this embodiment includes a screw-on ring (10), a jar (or vessel) (11), a metal seal disc (19), and a bento box separator according to certain embodiments of the invention (20).

FIG. 24 illustrates a perspective view of a bento box separator according to certain embodiments of the invention, in an upside up (A) and bottom up (B) position. The bento box separator in this embodiment includes a collar (or annular region) with nub (21), an interior (22), and a contoured region (23). In certain embodiments, a bento box separator of the current invention does not include a collar with a nub and/or a contoured region.

FIG. 25 illustrates a side view of a bento box separator according to certain embodiments of the invention, showing the complete separator (A), a cross section along the A-A line (B), and an enhanced detail view of the rim (C). The bento box separator in this embodiment includes a collar with nub (21), an interior (22), and a contoured region (23).

FIG. 26 illustrates an upside view of a bento box separator according to certain embodiments of the invention. The bento box separator in this embodiment includes a collar with nub (21), an interior (22), and a contoured region (23).

According to certain embodiments, a lid of the invention is sufficiently thin to be lightweight. In certain other embodiments, a lid of the invention fits comfortably within the screw clamp assembly, such as 0.5-3 mm. On the underside face of the device is a beveled lip 1-5 mm wide and 1-3 mm deep that travels the circumference of the device to aid in sealing. A similar bevel exists on the upper face to seal the device-screw clamp assembly from either direction.

In certain other embodiments, a protrusion of a lid of the invention has a form or shape that rises up to 5 cm from the upper face of the device and has a cut out circle or oval of 0.5-3 cm diameter to allow liquid to pass through and another 0.1-2 mm hole to allow air to flow into the container during drinking.

In certain embodiments, a lid of the invention has a hole or opening for removing liquid (or other food) from a beverage container on which the lid is used. In certain embodiments, a hole or opening for removing liquid (or other food) from a beverage container may be of any shape, for example, round, oval, diamond, square, rectangular, and it may have a diameter along its longest axis of 0.4 to 3 cm, or 0.5 to 3 cm, or 0.8 to 2 cm, or 0.8 to 1.5 cm, or 0.8 to 1.2 cm. In certain embodiments, a hole or opening for removing liquid (or other food) from a beverage container may be located on a protrusion of the lid or not on a protrusion, and it may be located (centered) 0.3 to 4.0 cm from the edge of the lid, or 0.5 to 3.0 cm, or 1.0 to 2.0 cm.

In certain embodiments, a lid of the invention has a hole or opening for facilitating equilibration of air (air flow) between the inside and outside of a beverage container on which the lid is used. In certain embodiments, a hole or opening for facilitating equilibration of air (air flow) may be of any shape, for example, round, oval, diamond, square, rectangular, and it may have a diameter along its longest axis of 1 to 10 mm, or 2 to 6 mm, or 2 to 4 mm, or 2 to 3 mm. In certain embodiments, a hole or opening for facilitating equilibration of air (air flow) may be located on a protrusion of the lid or not on a protrusion, and it may be located (centered) 0.3 to 4.0 cm from the edge of the lid, or 0.5 to 3.0 cm, or 1.0 to 2.0 cm.

In certain further embodiments, a lid of the invention is preferably 1 cm to 100 cm in diameter, more preferably 2 cm to 50 cm in diameter, even more preferably 3 cm to 30 cm in diameter, even more preferably 7 cm to 11 cm in diameter. In certain preferred embodiments, a lid of the current invention has a diameter or footprint so that its outside perimeter rests on the wall of the beverage container that defines the opening on which the lid is used. In certain embodiments, a lid of the current invention has a diameter that is 4 to 30 millimeter larger than the inner diameter of the opening of a beverage container on which the lid is used, for example a jar, more preferably 6 to 24 millimeter, or 6 to 18 millimeter, or 8 to 18 millimeter, or 8 to 12 millimeter, or 10 to 12 millimeter, or 10 millimeter. In certain embodiments, a lid of the current invention useful for a jar with a regular mouth of 60 millimeter has a diameter of 66 to 74 millimeter, or 68 to 72 millimeter, or 70 to 72 millimeter, or 70 millimeter. In certain embodiments, a lid of the current invention useful for a jar with a wide mouth of 76 millimeter has a diameter of 82 to 90 millimeter, or 84 to 88 millimeter, or 86 to 88 millimeter, or 86 millimeter. In certain embodiments, a lid of the current invention useful for a Kilner Jar and a Leifheit Jar with an opening of 72 millimeter has a diameter of 78 to 86 millimeter, or 80 to 84 millimeter, or 82 to 84 millimeter, or 82 millimeter.

In certain other embodiments, a lid of the invention has a protrusion forming a pouring spout or a sipping spout that may rise from the upper face of the lid from 1 cm to 100 cm in length, more preferably 1 cm to 50 cm in length, even more preferably 1 cm to 30 cm in length, even more preferably 1 cm to 11 cm in length.

In certain further embodiments of the invention, the ratio of the diameter of the lid to the height of the sipping spout above the plane of the lid is 1:1, or 2:1, 2.8:1, 3:1, 4:1, or in the range of 2-5:1. In certain embodiments, a protrusion of a lid of the invention has a diameter that is 6 to 40 millimeter less than the maximum diameter of the lid, or 10 to 35 millimeter, or 15 to 30 millimeter, or 20 to 30 millimeter, or 20 to 25 millimeter, or 25 to 30 millimeter.

In certain further embodiments, a lid of the invention may be constructed out of metal, plastic, or any other sufficiently durable material. In certain embodiments, a lid of the invention is made of a material that is non-toxic, that has regulatory clearance, that is used in food containers, that is biodegradable, that is cost efficient, that is taste neutral, and/or that has an appearance which is pleasing to users.

In certain embodiments, a bento box separator of the current invention has a diameter of its body (the part that is inserted into a beverage container) that is as large as possible but small enough to fit into the opening of a beverage container in which it is used, for example a jar. In certain embodiments, bento box separator has a diameter of its body that is 0.1 to 2 millimeters less than the diameter of the opening of the beverage container in which it is used, or 0.2 to 1.5 millimeter, or 0.2 to 1.0 millimeter, or 0.5 to 1.5 millimeter, or 0.5 to 1.0 millimeter. In certain embodiments, a bento box separator of the current invention useful for a jar with a regular mouth of 60 millimeter has a diameter of the body of 58 to 59.9 millimeter, or 58.5 to 59.8 millimeter, or 59.0 to 59.8 millimeter, or 58.5 to 59.5 millimeter, or 59.0 to 59.5 millimeter. In certain embodiments, a bento box separator of the current invention useful for a jar with a wide mouth of 76 millimeter has a diameter of the body of 74 to 75.9 millimeter, or 74.5 to 75.8 millimeter, or 75 to 75.8 millimeter, or 74.5 to 75.5 millimeter, or 75.0 to 75.5 millimeter. In certain embodiments, a bento box separator of the current invention useful for a Kilner Jar and a Leifheit Jar with an opening of 72 millimeter has a diameter of the body of 70.0 to 71.9 millimeter, or 71.5 to 71.8 millimeter, or 71.0 to 71.8 millimeter, or 70.5 to 71.5 millimeter, or 71.0 to 71.5 millimeter.

In certain embodiments, a lid of the invention is made of polypropylene. Polypropylene does not absorb flavors or colors, and it is free from harmful chemicals like pthalathes and BPA (bisphenol A). Polypropylene also does not transmit the temperature from a hot beverage to the skin of someone using a lid of the current invention, and it therefore insulates the lips from hot beverages, unlike metals which transmit heat.

A lid of the current invention, in certain embodiments, is made of other common food safe plastics, for example, polyethylene terephthalate, polyethylene, high-density polyethylene, low-density polyethylene, polyethylene, plastarch material (thermoplastic made from modified cornstarch). In certain other embodiments, a lid of the invention is made of less common non-food safe plastics, for example, polystyrene, polyvinyl chloride, parkesine, bakelite, polyester, polyvinylidene chloride, high impact polystyrene, polyamides (nylons), acrylonitrile butadiene styrene, polyethylene/acrylonitrile butadiene styrene, polycarbonate, polycarbonate/acrylonitrile butadiene styrene, polyurethanes, melamine formaldehyde, phenolics, polyetheretherketone, polyetherimide, polylactic acid, polymethyl methacrylate, polytetrafluoroethylene, urea-formaldehyde.

In certain other embodiments, a lid of the current invention is made of non-plastic materials, for example, stainless steel, low-carbon medical-grade stainless steel (304L or 316L), treated stainless steel (coated, painted, chemically plated, heat treated, thermally sprayed), aluminum (coated, painted, chemically plated, anodized, heat treated, thermally sprayed), steel (coated, painted, chemically plated [ie: chromed, etc], heat treated, thermally sprayed) silicone rubber, natural rubber, latex, felt, wood, leather, ceramic materials, porcelain, glass and glass-like materials, fiberglass, carbonfiber, and cork.

A lid of the current invention, in certain embodiments, is manufactured by a process known in the art, for example, components could be injection molded, liquid molded (like in the case of silicone), vacuum formed, thermoformed, stretch-blow molded, compression molded, calendering, transfer molded, laminated, fiberglass molded, pultruded, filament wound, rotational molded, manually molded, slip cast, hand burnished, hand formed, ground, filed, turned, cast (die, sand, shell, spin, investment, centrifugal), extruded, rolled, rubber pad formed, sheared, superplastic formed, hydroformed, coined, decambered, deep drawn, flowformed, spun, stamped, progressive die stamped, fashioned from other existing products, retrofit, waterjet cut, EDM, sawed, chiseled, milled/machined, forged, light-activated resin hardening, sun-baked, UV cured, chemically cured, dried.

In certain embodiments, a lid of the current invention is made by combining multiple pieces of material to create a single piece resembling the lid by being welded, brazed, soldered, riveted, plastic welded, sewn, solvent bonded, melted, glued, friction welded, friction fit, press fit, and baked.

In certain embodiments, the present invention provides a lid that is fixed to the top of a jar by a lid fastener. In certain embodiments of the invention, a lid is fixed to the top of a jar by a screw-on ring. In certain other embodiments, the invention provides a lid that is fixed to the top of a jar by a two piece screw clamp compression system.

In certain embodiments, the invention provides a dribble proof lid, when secured to the jar the lip of the lid extends beyond the rim of the jar for easy pouring from the jar. In certain other embodiments, the invention provides a bento box separator, that is it provides a watertight container to separate the contents of the jar into two, and allows for the canning cap/seal to be used on top of the invention.

In certain embodiments, the invention provides for a lid with a hole appropriate for a straw to be inserted. In certain other embodiments, the invention provides for a speed pourer so that liquid can be dispensed from the jar. In certain further embodiments, the invention provides a lid for a beverage container, comprising a container lid for removable association with the rim of an associated liquid container, a drinking area formed in a portion of the said container lid, said drinking area including an opening that allows liquid to flow through.

In a certain preferred embodiment, the invention provides a plastic replacement lid for a Mason jar, with a drinking spout for drinking coffee or any other liquid in any viscosity, a small air equilibration hole in the lid opposite the drinking spout, and a ridge especially adapted for use with the screw-on band typical of a Mason jar along the outer edge, to hold the lid in place.

In certain embodiments, a lid and a bento separator of the current invention do not include a downward concentric extrusion on the outside surface of a beverage container, for example a glass canning jar. Protruding elements from the plane of the top lip of a beverage container, for example a threaded canning jar, are limited, in certain embodiments, to the region of the lid and the bento separator that is contained inside of the diameter of the mouth opening of the beverage container, for example a canning jar, whether shaped into the container (for example a jar) opening or away from the container (for example a jar) body.

In certain embodiments, a lid and a bento separator of the current invention may appear in the natural color of the material it is made of, or it may appear in a color other than the natural color of the material. In certain embodiments, a lid and a bento separator may be fully opaque, or translucent, or semi-opaque, or transparent.

In certain embodiments, a lid and a bento separator of the current invention may appear in smooth or rough state or incorporate engineered surfaces, for example, painting, chemical treatments, brushing, polishing, sandblasting, and laser or water or acid etched, or machined patterns, or a combination of these or other processes and finishes.

In certain embodiments, a lid and a bento separator of the current invention is made of a material that is compatible with its use with food items for consumption by humans and animals. In certain embodiments, a lid and a bento separator of the current invention is made of a material with uniform physical properties, a material with color and processing stability, a material with low odor and taste, a material that is free from toxins and harmful chemicals, and/or a material that can be recycled. In certain embodiments, a lid and a bento separator of the current invention is made using a color additive and/or a finishing process that is safe for use with food items for consumption by humans and animals.

It will be recognized by one skilled in the art that in addition to Mason jars other jars may be used with a lid according to the invention, including but not limited to Kilner jars, fruit jars, mouth-blown canning jars with and without a ground rim, bead sealed jars, shoulder sealed jars, continuous external screw thread jars, quart jars, half-gallon jars, groove-ring type jars, Hemingray jars, Improved Masons, rim sealing jars, straddle-lip top seal jars, jars with a screw thread finish, narrow mouth jars, and external screw cap jars.

A lid of the current invention can be used with a beverage container made of any material. For example, jars may be made from soda-lime glass or plastic. A lid of the current invention may be used with a jar of any dimension, for example, a regular mouth canning jar with a 2⅜" (60 mm) diameter opening, or a wide mouth canning jar with a 3" (76 mm) mouth diameter opening. A lid of the current invention may be used with a beverage container of any size, for example, from a few ounces to half a gallon.

A lid of the current invention may also be used with international models of beverage containers, for example canning jars like a Kilner Jar and a Leifheit Jar, both having a 2 13/16 (72 mm) diameter opening. A metal seal disc for this type of jar is ~3 7/16" (84 mm) in diameter. These jars come in a variety of sizes as well, all with this mouth opening size. These jars are rated in lbs and come in 1, 2, 3, and 4 lb sizes. Some Kilner jars do not use the metal compression ring type enclosure, instead using metal clips to hold a glass lid with rubber seal onto the mouth of the jar.

Jars are generally measured by the size of the internal diameter of the mouth opening. The jar is the guide for the sizing of a lid of the current invention that may be used with the jar. Jars are also referred to as Wide Mouth, Regular Mouth, and internationally as Kilner. Jars are usually not described by the actual size of the jar due to their standardization.

Many sauce containers that can be purchased at a grocery store also have threading and standard sizing like Regular and Wide mouth canning jars. Regular and wide mouth size is preferably used with a lid of the current invention, but other sizes may be used too. These jars are typically not provided with the two piece construction canning jar lid (lid and compression ring) instead they come with a one-piece vacuum sealed lid. A lid of the current invention, in certain embodiments, may be used with a jar, or other beverage container, that does not have a screw-on ring, preferably by using a screw-on ring from another container, for example a jar. This is generally feasible since the openings of beverage containers like jars are generally one of a few uniform dimensions, for example, a regular or wide mouth jar. Therefore, a screw on ring from one container like a jar can be used on another container with an opening of the same dimension.

In addition to screw-on rings, the clamping mechanism for use with a lid of the invention may be a screw-on band, a compression ring, a two part compression ring, a compression band, a two-part compression band, an external threaded screw cap, a screw clamp assembly, and a screw-top lid, or a means for compressing a lid to the lip of a jar.

In certain embodiments of the invention, methods are provided for covering a beverage container with a lid of the current invention and for using a beverage container with a lid of the current invention. A method of the current invention, in certain embodiments, comprises placing a lid of the invention on an opening of a beverage container, for example a jar, and attaching the lid to the beverage container, for example through a screw-on ring. In certain other embodiments, a method of the invention comprises using a beverage container with a lid of the current invention for consuming a beverage.

In certain embodiments of the invention, methods are provided for dividing a beverage container with a bento box separator of the current invention and for using a beverage container with a bento box separator of the current invention. A method of the current invention, in certain embodiments, comprises inserting a bento box separator of the invention into an opening of a beverage container, for example a jar, and closing the beverage container, for example through a screw-on ring. In certain other embodiments, a method of the invention comprises using a beverage container with a bento box separator of the current invention for transporting and/or consuming a beverage or food item.

In certain embodiments, methods are provided for dividing a beverage container with a bento box separator of the current invention and for covering the beverage container with a lid of the current invention. A method of the current invention, in certain embodiments, comprises inserting a bento box separator of the invention into an opening of a beverage container, for example a jar, and placing a lid of the invention on the opening of the beverage container, and attaching the lid to the beverage container, for example through a screw-on ring. In certain other embodiments, a method of the invention comprises using a beverage container with a bento box separator and a lid of the current invention for transporting and/or consuming a beverage or food item.

In describing the preferred embodiments of the present invention illustrated in the Figures, specific terminology is employed for the sake of clarity. The invention, however, is not intended to be limited to the specific terminology so selected, and it is to be understood that each specific element includes all technical equivalents which operate in a similar manner to accomplish a similar purpose.

The present invention is not to be limited in scope by the specific embodiments described herein, which are intended as single illustrations of individual aspects of the invention, and functionally equivalent methods and components are within the scope of the invention. Indeed, various modifications of the invention, in addition to those shown and described herein, will become apparent to those skilled in the art from the foregoing description. Such modifications are intended to fall within the scope of the appended claims. All cited publications, patents, and patent applications are herein incorporated by reference in their entirety for any purpose.

What is claimed is:

1. A lid comprising a bottom surface and a protrusion, wherein said lid has a circular shape;

wherein said lid has a diameter of 66 to 74 millimeter or a diameter of 82 to 90 millimeter;

wherein said lid is made of a BPA-free and thermoplastic material;

wherein said lid can fit within a screw-on ring for a Mason jar;

wherein the bottom surface can travel the circumference of the opening of said Mason jar for sealing of the contact area between the lid and the Mason jar when the lid is attached to the Mason jar with the screw-on ring;

wherein the height of the protrusion is up to 5 centimeters, and wherein the protrusion defines a top surface of the lid that extends at a non-parallel angle away from the bottom surface of the lid;

wherein said lid comprises a hole for removal of liquid from said Mason jar, the hole defining a diameter along its longest axis of at least 0.8 centimeters, and the lid further comprising a venting hole distinct from the hole for removal of liquid; and wherein said lid does not include a downward concentric extrusion on the outside of said Mason jar.

2. The lid according to claim 1, wherein said hole is a hole for drinking, pouring, and/or inserting a straw.

3. The lid according to claim 1, wherein said venting hole has a diameter along its longest axis of 2 to 3 millimeter.

4. The lid according to claim 1, wherein said lid has a thickness of 0.5 to 3 millimeters.

5. The lid according to claim 1, wherein said protrusion comprises a pouring spout, a baby nipple or a fruit juicer.

6. A method for sealing a Mason jar comprising placing a lid according to claim 1 onto the opening of a Mason jar and attaching said lid to said Mason jar with a screw-on ring.

7. The method according to claim 6, wherein the lid is a lid according to claim 2.

* * * * *